US010302274B2

(12) United States Patent
Liu et al.

(10) Patent No.: US 10,302,274 B2
(45) Date of Patent: May 28, 2019

(54) LUMINAIRE, MODULAR SURFACE COVERING ARRANGEMENT AND LUMINAIRE KIT

(71) Applicant: SIGNIFY HOLDING B.V., Eindhoven (NL)

(72) Inventors: Alex Feng Liu, Eindhoven (NL); Riemer Adema, Eindhoven (NL); Mariusz Jankow, Eindhoven (NL); Aleksander Zach, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 70 days.

(21) Appl. No.: 15/166,206

(22) Filed: May 26, 2016

(65) Prior Publication Data

US 2016/0369951 A1 Dec. 22, 2016

(30) Foreign Application Priority Data

Jun. 16, 2015 (WO) ..... PCT/CN2015/081577
Sep. 2, 2015 (EP) ..... 15183472

(51) Int. Cl.
*F21V 3/02* (2006.01)
*F21S 8/02* (2006.01)
(Continued)

(52) U.S. Cl.
CPC ..... *F21V 3/02* (2013.01); *F21K 9/175* (2013.01); *F21S 8/026* (2013.01); *F21V 7/22* (2013.01);
(Continued)

(58) Field of Classification Search
CPC ... F21V 3/02; F21V 29/10; F21V 7/22; F21V 17/16; F21V 5/00; F21V 7/005; F21K 9/175; F21S 8/026; F21S 2/00
(Continued)

(56) References Cited

U.S. PATENT DOCUMENTS 9,052,075 B2 6/2015 Demuynck
9,052,090 B1 6/2015 Laso
(Continued)

FOREIGN PATENT DOCUMENTS

CN 203052298 U 7/2013
CN 104406128 A 3/2015
GB 2520344 A 5/2015

*Primary Examiner* — Andrew J Coughlin
*Assistant Examiner* — Meghan K Ulanday

(57) ABSTRACT

A luminaire is disclosed comprising a cover plate including an light exit window and a region surrounding the light exit window, at least a part of said region comprising a plurality of first fixing members selected from one of a plurality of holes and a plurality of protrusions dimensioned to extend through said holes; a reflector having an inner volume and comprising at least one edge comprising a plurality of second fixing members, selected from the other of the plurality of holes and the plurality of protrusions dimensioned to extend through said openings; and a plurality of solid state elements within the inner volume, wherein the protrusions extend through the holes, each protrusion having a portion extending beyond the opening through which the protrusion extends, said portion being bent over an edge of the opening to secure the reflector on the cover plate, wherein the inner volume is delimited by the reflector and the cover plate and the solid state lighting elements are arranged to direct their luminous output towards the light exit window. A modular surface covering arrangement including such a luminaire and a kit for assembling such a luminaire are also disclosed.

11 Claims, 5 Drawing Sheets

(51) Int. Cl.

| | |
|---|---|
| ***F21V 7/22*** | (2018.01) |
| ***F21V 17/16*** | (2006.01) |
| ***F21V 29/10*** | (2015.01) |
| ***F21K 99/00*** | (2016.01) |
| *F21S 2/00* | (2016.01) |
| *F21V 5/00* | (2018.01) |
| *F21V 7/00* | (2006.01) |
| *F21Y 103/10* | (2016.01) |
| *F21Y 115/10* | (2016.01) |
| *F21Y 101/00* | (2016.01) |

(52) U.S. Cl.
CPC ..... *F21V 17/16* (2013.01); *F21V 29/10* (2015.01); *F21S 2/00* (2013.01); *F21V 5/00* (2013.01); *F21V 7/005* (2013.01); *F21Y 2101/00* (2013.01); *F21Y 2103/10* (2016.08); *F21Y 2115/10* (2016.08)

(58) Field of Classification Search
USPC ..... 362/223
See application file for complete search history.

(56) References Cited

U.S. PATENT DOCUMENTS

| | | | |
|---|---|---|---|
| 2009/0196024 | A1 | 8/2009 | Heiking |
| 2009/0279297 | A1 | 11/2009 | Kpenv |
| 2012/0300471 | A1 | 11/2012 | Howe |

LUMINAIRE, MODULAR SURFACE COVERING ARRANGEMENT AND LUMINAIRE KIT

FIELD OF THE INVENTION

The present invention relates to a luminaire such as a troffer for a modular surface covering arrangement.

The present invention further relates to a modular surface covering arrangement including such a luminaire.

The present invention yet further relates to a luminaire kit for assembling such a luminaire.

BACKGROUND OF THE INVENTION

In the illumination of work environments, e.g. office lighting, the visual quality of the lighting installation is an important factor in the perception of the lighting. This applies to both recessed and surface mounted lighting installations. The shape of the luminaires in such installations is an important design parameter to achieve the desired appearance of the lighting installation. A luminaire having a high degree of flatness and side wall linearity for instance facilitates the avoidance of unnecessary gaps between luminaires and other elements of the lighting installation, e.g. floor or ceiling tiles of for instance a concealed profile (CP) or plaster ceiling (PC) installation. Where such a luminaire is integrated in a surface mounted installation, the luminaire should have a gap to the ceiling that is as uniform as possible in order to achieve a good linearity perception. Flatness and side wall linearity of luminaires also help to more effectively provide the mechanical and electrical infrastructure of such lighting installations. In addition, front surface smoothness of the luminaire is also advantageous in order to give the lighting installation its desired look and feel.

It is not straightforward to provide a luminaire having the desired flatness and side wall linearity in a cost-effective manner. The manufacturing of such luminaires is typically quite complex using many components and therefore expensive and not environmentally friendly. This can prohibit large-scale adoption of such lighting installation, at least for economic reasons.

U.S. Pat. No. 9,052,075 B2 discloses a troffer fixture for solid state lighting sources. The fixture comprises a door frame assembly that is attached to the pan. The pan housing is defined by a base and two angled side walls. End caps are attached to the side walls. End reflectors extend at an angle away from the end caps and attach to the base. The end caps, the end reflectors, and the base define compartments at both ends of the housing in which components can be housed. A light board is attached to the base using alignment holes in the base and cut-out portions of the end reflectors. The end reflectors retain elements within the compartments, provide added structural stability to the pan, aid in aligning a light board, and reflect light that impinges on them toward the open end of the fixture.

SUMMARY OF THE INVENTION

The present invention seeks to provide a luminaire achieving a high degree of flatness and linearity in a cost-effective manner.

The present invention further seeks to provide a modular surface covering arrangement including such a luminaire as a troffer.

The present invention yet further seeks to provide a luminaire kit for assembling such a luminaire with low price and manufacturing efficiency.

According to an aspect, there is provided a luminaire comprising a cover plate including an light exit window and a region surrounding the light exit window, at least part of said region comprising a plurality of first fixing members selected from one of a plurality of holes and a plurality of protrusions; a reflector comprising at least one edge comprising a plurality of second fixing members which are a plurality of holes in case the first fixing members are a plurality of protrusions and which are a plurality of protrusions in case the first fixing members are a plurality of holes, wherein the protrusions extend through the holes, each protrusion having a portion extending beyond the opening through which the protrusion extends, said portion being bent over an edge of the opening to secure the reflector on the cover plate; and a plurality of solid state elements within an inner volume delimited by the reflector and the cover plate, wherein the solid state lighting elements are arranged to direct their luminous output towards the light exit window. By using the reflector as the housing and a simple connection mechanism for assembling a flat cover onto the reflector housing, a luminaire with excellent flatness and side wall linearity can be achieved in a cost-effective manner without requiring relatively complex and/or time-consuming assembly techniques such as spot welding or screwing.

Preferably, the first fixing members are protrusions and the second fixing members are holes such that the bent-over portions of the first fixing members are invisible when the luminaire is mounted in a modular surface covering arrangement such as a modular ceiling arrangement.

To this end, the region may comprise a rim fully around the light exit window that is angled to a main surface of the cover plate, the protrusions extending from the rim. This is a particularly cost-effective implementation of the cover plate, which furthermore facilitates easy assembly.

In a particularly advantageous embodiment, the luminaire further comprises a diffuser plate mounted in between the reflector and the cover plate such that the diffuser plate covers the entire light exit window in order to reduce glare and improve the overall appearance of the luminaire. Such a flat or 2D diffuser can be provided in a more cost-effective manner than the moulded 3D diffusers usually integrated in luminaires for modular surface covering arrangements. In some embodiments, the flat diffuser may comprise a plurality of micro-lenses or a texture on a major surface.

The diffuser plate typically comprises an outer region and is dimensioned such that the outer region is placed between the at least one reflector edge and the cover plate region, the outer region comprising a plurality of notches arranged to allow the protrusions to extend into the holes, such as recesses in the outer region of the diffuser plate. This ensures that the entire light exit window is covered by the diffuser in a straightforward and cost-effective manner without the diffuser interfering with the assembly of the cover plate and the reflector.

The cover plate may comprise a plurality of light exit windows each comprising a region surrounding the light exit window, at least a part of each region comprising a plurality of first fixing members such that the luminaire can deliver multiple light outputs, which for instance may be advantageous to control the illuminance distribution provided by the luminaire.

To this end, the luminaire may further comprise a plurality of reflectors, each having an inner volume and comprising at least one edge comprising a plurality of second fixing members and a plurality of solid state elements mounted in the inner volume, each reflector mating with one of the regions.

The reflector may be a sheet metal reflector bent in a desired shape or a plastic reflector moulded into a desired shape. Alternatively, the reflector may be produced by die-casting or a similar process. Such reflectors can be manufactured in a cost-effective manner, thus reducing the overall cost of the luminaire.

The plurality of solid state elements preferably is thermally coupled to the reflector in order to control the temperature of the solid state elements. This obviates the need for a separate heat spreader and/or heat sink, thus further lowering the cost of the luminaire.

In at least some embodiments, the luminaire is a troffer for a modular surface covering arrangement.

According to another aspect, there is provided a modular surface covering arrangement such as a modular ceiling arrangement, comprising a plurality of covering tiles supported by a support grid and at least one such a troffer. Such a modular surface covering arrangement may exhibit high uniformity due to the excellent flatness and side wall linearity of the luminaire, and moreover may be provided at lower cost than existing modular surface covering arrangements.

According to yet another aspect, there is provided a luminaire kit for assembling the luminaire of any of the above embodiments, the kit comprising a cover plate including an light exit window and a region surrounding the light exit window, at least a part of said region comprising a plurality of first fixing members selected from one of a plurality of holes and a plurality of protrusions; a reflector delimiting an inner volume and comprising at least one edge comprising a plurality of second fixing members, which are a plurality of holes in case the first fixing members are a plurality of protrusions and which are a plurality of protrusions in case the first fixing members are a plurality of holes, said protrusions dimensioned to extend through said holes, wherein the first fixing members and second fixing members are positioned for mating with each other; and a plurality of solid state elements within the inner volume. Such a luminaire kit facilitates the assembly of the luminaire of at least some of the embodiments of the present invention in a straightforward and cost-effective manner. It is noted for the avoidance of doubt that it is not essential that the luminaire according to such embodiments is assembled from the luminaire kit; the luminaire may be assembled in any suitable manner.

The luminaire kit may further comprise a diffuser plate adapted to be mounted in between the reflector and the cover plate and to cover the light exit window. The diffuser plate typically comprises an outer region and is dimensioned such that the outer region is placed between the at least one reflector edge and the cover plate region, the outer region comprising a plurality of notches arranged to allow the protrusions to extend into the holes, such as recesses in the outer region of the diffuser plate. This ensures that the entire light exit window is covered by the diffuser in a straightforward and cost-effective manner without the diffuser interfering with the assembly of the cover plate and the reflector. Furthermore, such a modular approach facilitates dismantling of a luminaire assembled from the kit, thus facilitating luminaire repairs or maintenance, e.g. the replacement of broken elements, cleaning inner surfaces of the reflector and/or diffuser plate, and so on, in order to support so-called circular economy approaches. This is not possible when welding techniques are used to secure the reflector and diffuser plate in such luminaires. Moreover, the securing of the luminaire by bending protrusions ensures that disassembly may be achieved without specialist tools.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
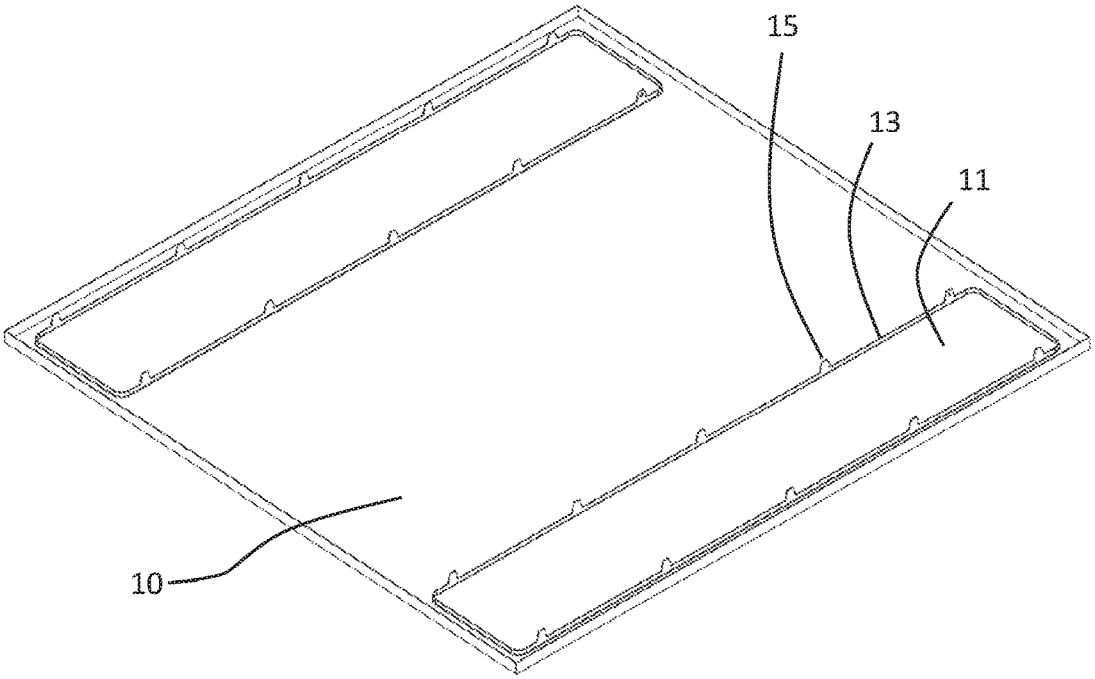
FIG. 1 schematically depicts a front plate according to an embodiment.

It should be understood that the Figures are merely schematic and are not drawn to scale. It should also be understood that the same reference numerals are used throughout the Figures to indicate the same or similar parts.

In the following, an example embodiment of the present invention will be described in terms of various components of a luminaire that are assembled in order to provide a luminaire according to the example embodiment. In some embodiments, the luminaire may form a troffer for a modular surface covering arrangement, e.g. a modular floor including the troffer or a modular ceiling arrangement, e.g. a PC or CP ceiling, including the troffer. Where the luminaire is implemented as such a troffer, it should be understood that the troffer may have any suitable dimension, e.g. a square outline of for instance 600×600 mm, an oblong outline such as for instance 300×1200 mm, or, when designed as a surface mounted luminaire, an outline of 200×1200 mm or any other suitable size. It will be understood by the skilled person that the dimensions of the luminaire may be readily adapted to a particular application of the luminaire, e.g. in a modular surface covering arrangement in which the modules have a particular size requirement.

The various components described in more detail below may be combined to form a luminaire kit from which the luminaire may be assembled on-site. Alternatively, the luminaire may be assembled from components that are separately marketed, i.e. not as a kit, or may be provided in assembled form.

FIG. 1 schematically depicts a cover plate 10 of a luminaire according to an embodiment. The cover plate 10 in FIG. 1 comprises two light exit windows 11 each delimited by a rim or edge 13 from which a plurality of bendable protrusions 15, e.g. tabs, extend. It should be understood that the cover plate 10 is shown to have two light exit windows 11 by way of non-limiting example only; the cover plate 10 may include any suitable number of light exit windows 11, e.g. a single light exit window 11 or a larger number of light exit windows 11, e.g. three or more light exit windows 11. The light exit windows 11 may be formed in the cover plate 10 in any suitable manner, for example by cutting out or punching out a region of the cover plate 10 to form the light exit windows 11. The cover plate 10 may be made of any suitable material but is preferably made of a material that facilitates the cutting out or punching out of the light exit windows 11 and allows the bending of the protrusions 15, e.g. a metal sheet such as an aluminium sheet, a metal alloy sheet, a steel plate, and so on. The rim or edge 13 may have a height of 0.5-6 mm. In an embodiment, the rim or edge 13 has a height of 4-5 mm, with the protrusions 15 having a height of 14-15 mm when measured from the rim or edge 13. It will be apparent to the skilled person that these are example dimensions only and that the rim or edge 13 and protrusions 15 extending therefrom may have any suitable dimensions.

Figure 2:
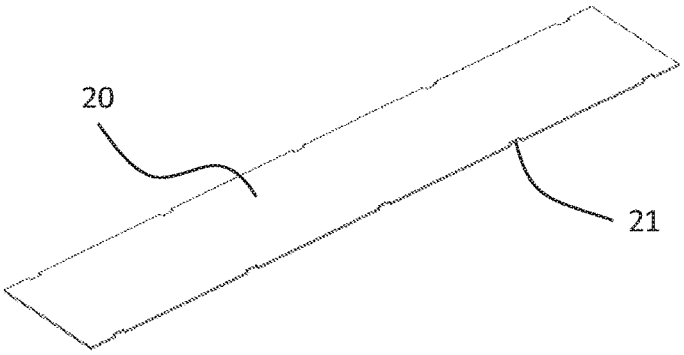
FIG. 2 schematically depicts a diffuser according to an embodiment.
Figure 3:
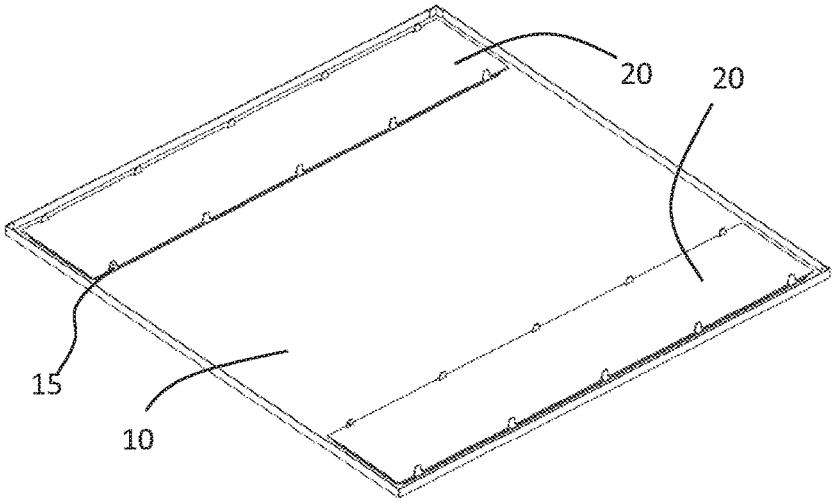
FIG. 3 schematically depicts a part-assembled luminaire according to an embodiment.

FIG. 2 schematically depicts a diffuser plate 20, i.e. a 2-dimensional (2D) diffuser, which optionally may be added to the luminaire design. The diffuser plate 20 typically comprises a plurality of notches 21 in an outer region or perimeter of the diffuser plate 20 that are positioned to align with the protrusions 15 of the cover plate 10. This is schematically shown in FIG. 3, in which two of such diffuser plates 20 overlay the light exit windows 11 of the cover plate 10, with the protrusions 15 on the rim or edge 13 around each light exit window 11 extending through the notches 21 of the diffuser plates 20. Consequently, the diffuser plate 20 is dimensioned such that it covers the entire light exit window 11, as the perimeter including the notches 21 overlaps with the edge or rim 13 of the light exit window 11. This, together with the reflector edge 33, therefore avoids light leakage past the diffuser plate 20 when the luminaire is operational.

It will be understood that the notches 21 may be replaced by any suitable opening or recess for allowing the protrusions 15 to extend beyond the diffuser plate 20; for example, it is equally feasible that the notches 21 are replaced by holes (not shown) that are enveloped by the diffuser material rather than exposed at one side as is the case with the notches 21. Such an aligning arrangement, i.e. providing notches 21 or the like to align with the protrusions 15, facilitates the mounting of the diffuser plate 20 onto the cover plate 10 without requiring separate fixing members, e.g. screws or the like, which simplifies the assembly of the luminaire and reduces its cost.

The diffuser plate 20 may be made of any suitable material, e.g. glass or a polymer such as polycarbonate, polyethylene terephthalate or poly (methyl methacrylate). Other suitable materials may be immediately apparent to the skilled person. In a particularly advantageous embodiment, the diffuser plate 20 is made of a polymer and may be manufactured in a straightforward manner using laser cutting or mould casting for example. The diffuser plate 20 may be made diffusive in any suitable manner, e.g. by surface etching, scattering particles in or on the diffuser plate 20, scattering paint on a surface of the diffuser plate 20 and so on.

Figure 4:
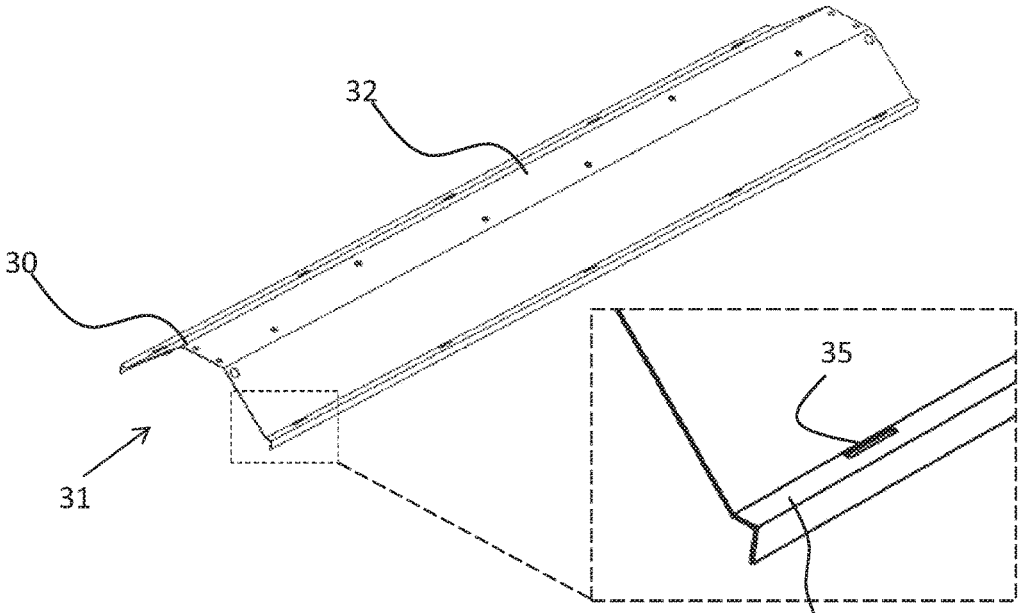
FIG. 4 schematically depicts a reflector according to an embodiment.

FIG. 4 schematically depicts a reflector 30 for the luminaire according to an embodiment. The reflector 30 at least has an inner volume 31 delimited by a reflective inner surface that faces the light exit windows 11 of the cover plate 10 when the luminaire is assembled as will be shown in more detail below. The reflector 30 may be made of a reflective material, e.g. a reflective metal, or may carry a reflective coating on its inner surface. The reflector 30 typically comprises a pair of edges 33 on opposite sides of the reflector 30, e.g. in a length direction of the reflector 30, which edges 33 comprise a plurality of holes or apertures 35 that are positioned such that they can receive the protrusions 15 of the cover plate 10. The reflector 30 is typically made of a bendable material such that the reflector 30 can be bent, punched and/or moulded into its desired shape. For example, the reflector 30 may be a sheet metal reflector punched and bent into its desired shape or a plastic reflector moulded into its desired shape.

Figure 5:
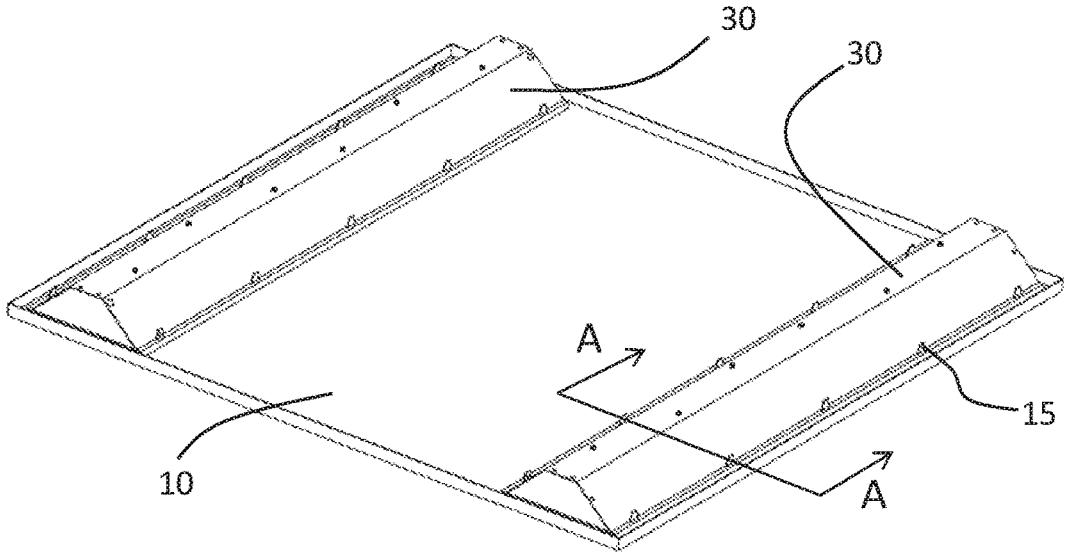
FIG. 5 schematically depicts a part-assembled luminaire according to an embodiment.

FIG. 5 schematically depicts two reflectors 30 mounted on the respective light exit windows 11 of the cover plate 10 to form the luminaire. In this embodiment, each light exit window 11 is fitted with a respective reflector 30 by way of non-limiting example only; it is for instance equally feasible that a single reflector 30 covers multiple light exit windows 11, such that a first edge 33 of the reflector 30 is engaged with a first rim portion 13 of a first exit window 11 and a second edge 33 of the reflector 30 opposite the first edge is engaged with a second rim portion 13 of a second exit window 11 of the cover plate 10, in such a manner that both the first and second exit windows 11 are fully covered by the single reflector 30.

The edges 33 are typically dimensioned such that a portion of the protrusions 15 extends beyond an edge 33 by a desired amount. In embodiments where the reflector 30 is positioned over an optional diffuser plate 20, the combined thickness of an edge 30 and the diffuser plate 20 is such that a portion of the protrusions 15 extends beyond an edge 33 by a desired amount. These portions may be bent or folded over the edge 33 in order to secure the reflector 33 on the cover plate 10 or vice versa. This is shown in more detail in FIG. 6, which schematically depicts an aspect of a luminaire 1 by way of the cross-section along the line A-A in FIG. 5. The bending action on the respective portions of the protrusions 15 is indicated by the curved block arrows, with potential final positions of the respective portions of the protrusions 15 indicated by the dashed lines to which these arrows point. Consequently, the reflector 30 may be secured on the cover plate 10 or vice versa without requiring additional fixing means and/or involved fixing techniques such as screwing or spot welding. Where the diffuser plate 20 is also present, a particularly advantageous luminaire 1 is obtained in which a cover plate, diffuser plate and reflector may be assembled into the luminaire 1 without requiring additional fixing means, in part by virtue of the diffuser plate shape including the notches 21 or equivalent apertures in the perimeter of the diffuser plate 20 that retain the diffuser plate 20 over a light exit window 11 by way of the engagement of the notches 21 or equivalent apertures with the protrusions 15.

Figure 6:
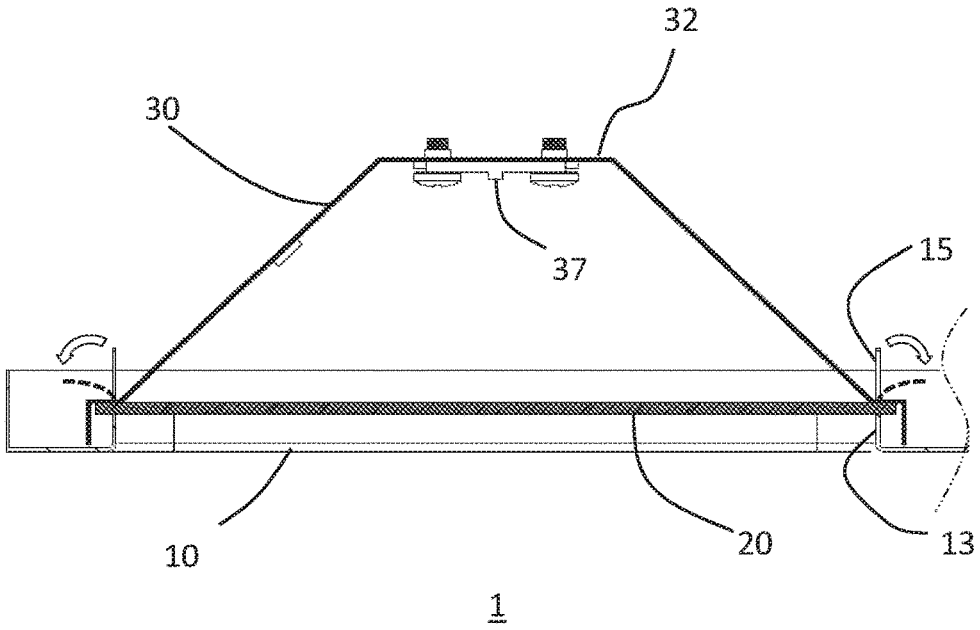
FIG. 6 is an enlarged sectional view along A-A in FIG. 5.

FIG. 6 furthermore schematically depicts a number of SSL elements 37 attached to a surface portion 32 of the reflector 30 such that the SSL elements 37 are arranged to emit their luminous outputs towards the light exit window 11 optionally covered by the diffuser plate 20. Any suitable number or type of SSL elements 37 may be attached to the surface portion 32, which may form a part of the reflective inner surface of the reflector 30 facing the light exit window 10 (or diffuser plate 20 over the light exit window 10). In an embodiment, the SSL elements 37 include light emitting diodes (LEDs), which for example may be incorporated in so-called chip-on-board or LED packages. The SSL elements 37 may be white light-emitting SSL elements, coloured light-emitting SSL elements or a combination thereof. The SSL elements 37 preferably are thermally coupled to the surface portion 32 such that the surface portion 32 can act as a heat spreader for the SSL elements 37, thus obviating the need for a separate heat spreader in the luminaire 1. In this embodiment, the reflector 30 is preferably made of a material having good thermal conductivity, e.g. a metal, metal alloy of thermal plastics material.

At this point, it is noted that although the cover plate 10 is shown to have protrusions 15 as first fixing members and the reflector 30 is shown to have holes or apertures 35 as second fixing members for receiving the first fixing members, i.e. receiving the protrusions 15 such that the protrusions 15 extend through the apertures 35 and are folded or bent over the edge 33 as previously explained, it is equally feasible for the cover plate 10 to comprise holes or apertures in at least a part of an edge region surrounding a light exit window 11 and for the reflector 30 to have protrusions extending from the edge regions 33 such that the protrusions can extend through the holes or apertures in the cover plate 10. This has the advantage that the cover plate 10 may be removed without having to remove the luminaire 1 from its mounting, e.g. a modular surface covering arrangement such as a modular ceiling, as the protrusions are bent over the exposed cover plate 10 such that the straightening of the bent protrusions will allow for the cover plate 10 (and the diffuser plate 20 when present) to be removed from the mounted luminaire 1, e.g. for servicing or replacement of one or more of the SSL elements 37. From an aesthetic perspective, this embodiment is less preferred as the bent protrusions will be visible on the exposed cover plate 10, which is aesthetically less pleasing that the embodiment in which the protrusions 15 extend from the cover plate 10 and are bent or folded over the hidden edges 33 of the reflector 30.

Figure 7:
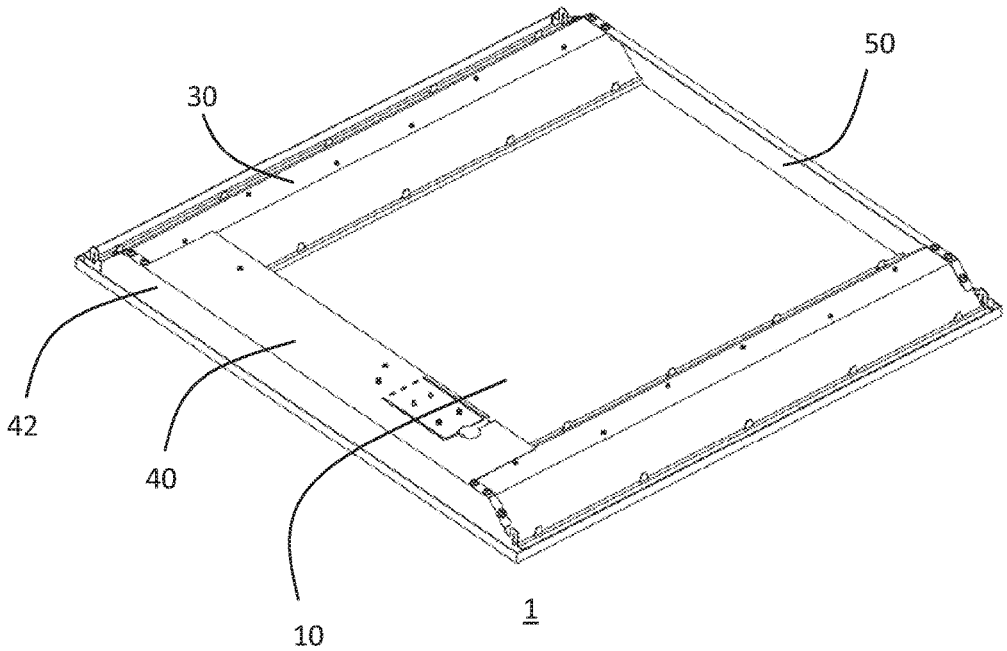
FIG. 7 schematically depicts a rear view of a luminaire according to an embodiment.

In an embodiment as schematically shown in FIG. 7, the luminaire 1, here shown in a rear view, may further comprise a compartment 40 including an end cover plate 42 for the reflectors 30, which may be mounted on the cover plate 10 and/or the reflector 30 in any suitable manner, e.g. using the first and second fixing members as described above or by means of fixing means such as screws or rivets. The compartment 40 may extend between neighboring or opposing reflectors 30 over a side section of the cover plate 10 in a direction substantially perpendicular to the length direction of the reflectors 30. The compartment 40 may house electrical components such as electrical connectors and drivers for the SSL elements 37. The luminaire 1 may further comprise at least one flange or lip 50 extending from the cover plate 10, e.g. forming a part of the cover plate 10 for supporting the luminaire 1 on a support frame of a modular surface covering arrangement such as a modular ceiling in case the luminaire 1 embodies a troffer for such an arrangement. It should be understood that the compartment 40 is optional; for instance, in case no driver is needed, e.g. in case of central DC power, the compartment 40 may be eliminated and replaced by a lip 50. Similarly, the lip 50 may be eliminated and its function provided by the compartment 40, e.g. if more electrical components need to be integrated, such as an emergency lighting module or a backup driver.

Figure 8:
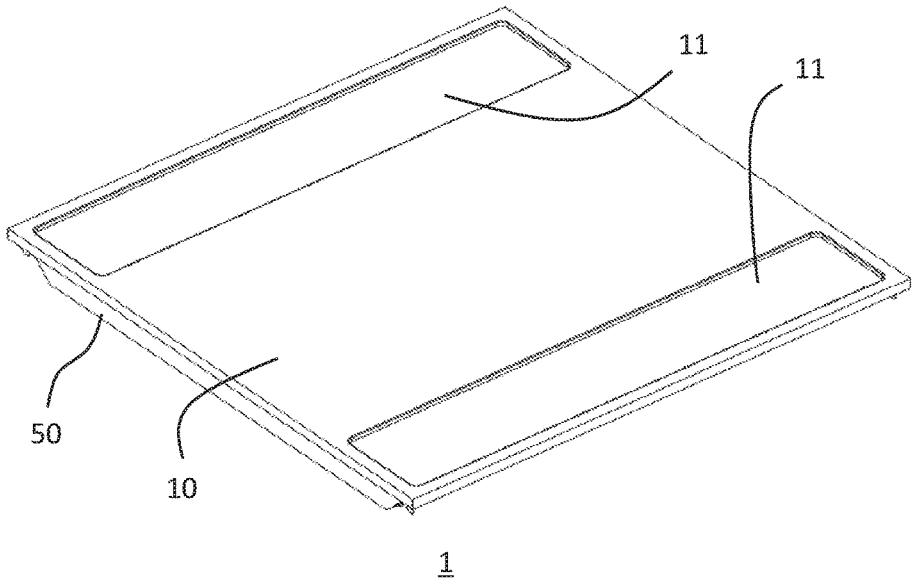
FIG. 8 schematically depicts a front view of the luminaire of FIG. 7.

FIG. 8 is a front view or exposed view of the luminaire 1 of FIG. 7, in which the cover plate 10, light exit windows 11 and the flange or lip 50 can be seen. The front view of the luminaire 1 appears with perfect flatness and side wall linearity due to the avoidance of spot welding to assemble the luminaire 1 in order for it to retain its high surface smoothness. At this point it is noted that the luminaire 1 achieves a pleasing visual appearance due to this perfect flatness whilst at the same time achieving excellent optical performance in terms of avoidance of light leakage along the diffuser plate 20 if present due to the overlap between the edge regions of the diffuser plate 20 and the region around the light exit windows 11 as well as the overlap between the edge regions of the diffuser plate with the edge regions 33 of the reflector 30, thereby defining an inner chamber that is optically sealed.

Figure 9:
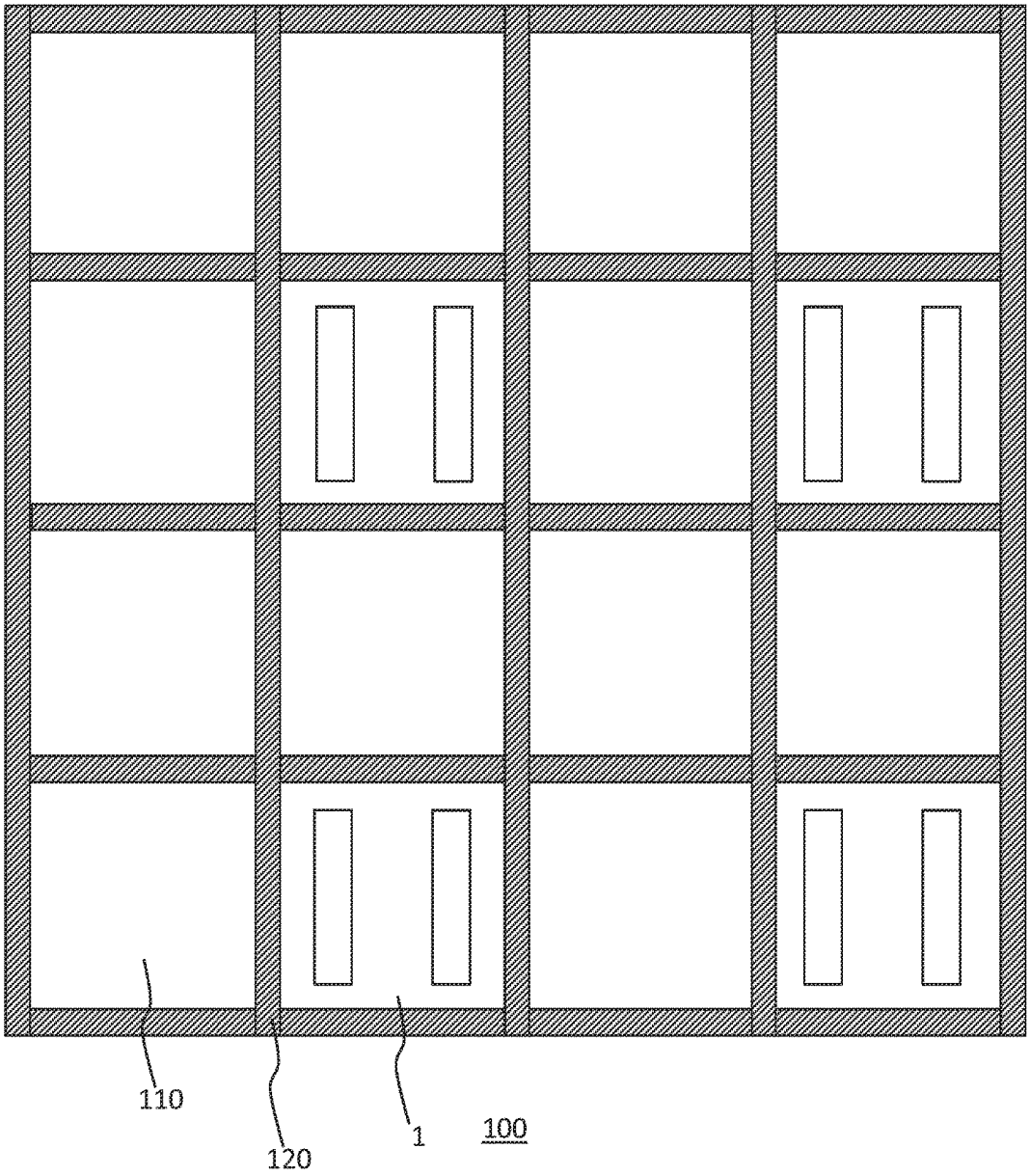
FIG. 9 schematically depicts a modular surface covering arrangement according to an embodiment.

FIG. 9 schematically depicts a front view of a modular surface covering arrangement 100 having a plurality of surface tiles 110 suspended in a support frame 120. The surface tiles 110 and the support frame 120 may be made of any suitable material depending on the application of the modular surface covering arrangement 100.

For example, where the modular surface covering arrangement 100 implements a modular ceiling, the surface tiles 110 and the support frame 120 do not need to be load-bearing and may be made of cheap lightweight materials such as polystyrene surface tiles 110 or the like and a plastics or aluminium the support frame 120 or the like.

For example, where the modular surface covering arrangement 100 implements a modular floor, the surface tiles 110 and the support frame 120 may need to be load-bearing and may be made of more sturdy materials, e.g. resilient materials having a minimum thickness.

The modular surface covering arrangement 100 further comprises at least one luminaire 1 according to any of the above embodiments and preferably comprises a plurality of such luminaires 1 for instance to achieve a homogeneous illumination pattern across an enclosed space in which the modular surface covering arrangement 100 is fitted or to deliver illumination in target areas within such an enclosed space, e.g. in walkways, over desks or shopping display areas, and so on. The surface tiles 110 and at least one luminaire 1 may be fitted in the support frame 120 in any suitable manner. For example, the tiles 110 and/or the at least one luminaire 1 may have a lip around an outer perimeter that extends over the support frame 120 such that the lip rests on the support frame 120. Alternatively, the tiles 110 and/or the at least one luminaire 1 may be dimensioned such that they are larger than an aperture for receiving the tiles 110 and/or the at least one luminaire 1 delimited by the support frame 120. The tiles 110 and/or the at least one luminaire 1 may have a recessed perimeter portion for receiving the support frame 120, with this recess preferably matching the thickness of the support frame 120 to obtain excellent planarity in the overall modular surface covering arrangement 100. Many other suitable mounting arrangements will be immediately apparent by the skilled person.

It is further noted that the surface tiles 110 and the luminaires 1 are shown to have the same dimensions in the modular surface covering arrangement 100 by way of non-limiting example only. It is equally feasible that the surface tiles 110 and the luminaires 1 have different sizes, e.g. the surface tiles 110 having a size that is a multiple of the size of a luminaire 1 or the luminaire 1 having a size that is a multiple of the size of a surface tile 110.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising:

a cover plate including a light exit window and a region surrounding the light exit window, at least a part of said region comprising a plurality of protrusions as first fixing members;

a reflector comprising at least one edge, the edge comprising a plurality of holes as second fixing members; wherein the protrusions extend through the holes, each protrusion having a portion extending beyond the opening through which the protrusion extends, said portion being bent over an edge of the opening to secure the reflector on the cover plate;

a plurality of solid state lighting elements within an inner volume delimited by the reflector and the cover plate, wherein the solid state lighting elements are arranged to direct their luminous output towards the light exit window;

wherein the region comprises a rim fully around the light exit window that is angled to a main surface of the cover plate, the protrusions extending from the rim;

a diffuser plate mounted in between the reflector and the cover plate such that the diffuser plate covers the entire light exit window; and wherein the diffuser plate comprises an outer region and is dimensioned such that the outer region is placed between the at least one reflector edge and the cover plate region, the outer region comprising a plurality of notches arranged to allow the protrusions to extend into the holes.

2. The luminaire of claim 1, wherein the notches are recesses in the outer region.

3. The luminaire of claim 1, wherein the cover plate comprises a plurality of light exit windows each comprising a region surrounding the light exit window, at least a part of each region comprising a plurality of first fixing members.

4. The luminaire of claim 3, further comprising a plurality of reflectors, each having an inner volume and comprising at least one edge comprising a plurality of second fixing members and a plurality of solid state lighting elements mounted in the inner volume, each reflector mating with one of the regions.

5. The luminaire of claim 1, wherein the reflector is a sheet metal reflector bent in a desired shape or a plastic reflector moulded into a desired shape.

6. The luminaire of claim 1, wherein the plurality of solid state elements is thermally coupled to the reflector.

7. The luminaire of any of claim 1, wherein the luminaire is a troffer for a modular surface covering arrangement.

8. A modular surface covering arrangement, comprising a plurality of covering tiles supported by a support grid and at least one luminaire according to claim 7.

9. The modular surface covering arrangement of claim 8, wherein the arrangement is a modular ceiling.

10. A luminaire kit for assembling the luminaire of claim 1, the kit comprising:

a cover plate including a light exit window and a region surrounding the light exit window, at least a part of said region comprising a plurality of protrusions as a plurality of first fixing members;

a reflector delimiting an inner volume and comprising at least one edge comprising a plurality of holes as second fixing members, said protrusions dimensioned to extend through said holes, wherein the first fixing members and second fixing members are positioned for mating with each other; and wherein the region comprises a rim fully around the light exit window that is angled to a main surface of the cover plate, the protrusions extending from the rim; and a plurality of solid state lighting elements within the inner volume.

11. The luminaire kit of claim 10, further comprising a diffuser plate adapted to be mounted in between the reflector and the cover plate and to cover the light exit window.

* * * * *